US006643892B1

(12) United States Patent
Murphy

(10) Patent No.: US 6,643,892 B1
(45) Date of Patent: Nov. 11, 2003

(54) DUST FUNNEL

(76) Inventor: Kevin M. Murphy, 925 24th St., Hermosa Beach, CA (US) 90254

( * ) Notice: Subject to any disclaimer, the term of this patent is extended or adjusted under 35 U.S.C. 154(b) by 70 days.

(21) Appl. No.: 10/097,035

(22) Filed: Mar. 14, 2002

(51) Int. Cl.[7] ..... A47L 13/52
(52) U.S. Cl. ..... 15/257.3; 15/257.6; 294/55; D32/74
(58) Field of Search ..... 15/257.1–257.9; D32/74; 294/55

(56) References Cited

U.S. PATENT DOCUMENTS

| | | | | | |
|---|---|---|---|---|---|
| 132,367 | A | * | 10/1872 | Musgrove | 15/257.2 |
| 760,391 | A | * | 5/1904 | Fuller | 15/257.2 |
| 768,871 | A | | 8/1904 | Albertson | 15/257.3 |
| 1,053,438 | A | | 2/1913 | Resch | 15/257.3 |
| 1,223,105 | A | * | 4/1917 | Pigott | 15/257.3 |
| 3,026,138 | A | * | 3/1962 | Benjamin et al. | 294/55 |
| 4,048,692 | A | | 9/1977 | Coffey | 15/257.2 |
| 4,562,611 | A | | 1/1986 | Marttinen | 15/257.7 |
| 4,686,734 | A | | 8/1987 | Kahan | 15/257.1 |
| 4,709,440 | A | | 12/1987 | Conelly | 15/257.3 |
| 5,031,277 | A | | 7/1991 | Coker | 15/257.3 |
| 5,367,737 | A | | 11/1994 | Vosbikian et al. | 15/257.2 |
| 5,715,564 | A | | 2/1998 | Knouse | 15/257.3 |
| 6,233,780 | B1 | | 5/2001 | Mead | 15/257.3 |

* cited by examiner

*Primary Examiner*—Mark Spisich
(74) *Attorney, Agent, or Firm*—James G O'Neill; Klein, O'Neill & Singh, LLP

(57) ABSTRACT

A cleaning device has a funnel-shaped body with a rotatable door held in an opening, adjacent a handle connected to the body. The door includes a trigger for opening the door, and the handle and body are angled for ease in collecting and dumping debris.

20 Claims, 3 Drawing Sheets

DUST FUNNEL

BACKGROUND OF THE INVENTION

1. Field of the Invention

This invention generally relates to cleaning devices, and more particularly, to an improved cleaning and pickup device for more effective cleaning and dumping of picked-up debris.

2. Description of the Prior Art

The cleaning device art is old and crowded and includes many types of devices, such as dust pans, to pick up debris brushed into them. However, known dust pans have a tendency to leak dust or debris and are not easily unloaded into a trash receptacle. Therefore, much effort has been directed toward enabling the known devices to more effectively pick up debris and to be emptied into trash containers.

Although some of the known devices work better than others, they still have not solved this problem, and, there still exists a need in the art for a device to more efficiently pick up debris and to more easily empty the picked-up debris into a trash container. There also exists a need to manufacture such a device an inexpensive and efficient manner and to easily stack such devices for shipping and storage.

SUMMARY OF THE INVENTION

Accordingly, it is a general object of the present invention to provide an improved and simplified cleaning device. It is a particular object of the present invention to provide an improved and simplified debris pickup device in the general form of a funnel. It is a further particular object of the present invention to provide an improved and simplified debris pick-up device having a pair of angled and tapered side walls secured to a bottom plate, a tapered top plate with a handle incorporated therein, and a rotatable rear door for ease in emptying debris swept into the device.

These and other objects of the present invention are achieved by providing a funnel-type device for use in picking up debris. The device includes a generally funnel-shaped body having a top handle on an upper surface and a pair of tapered and angled side walls secured between the upper surface and a lower surface between a wider front edge and a narrower rear edge. A door is rotatably secured to the upper surface between the front edge and the rear edge of the upper and lower surfaces. The door includes a trigger for operation of the door to empty the device of debris held therein, when the device is turned and held over a trash container.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, wherein:

DESCRIPTION OF THE PREFERRED EMBODIMENTS

Figure 1:
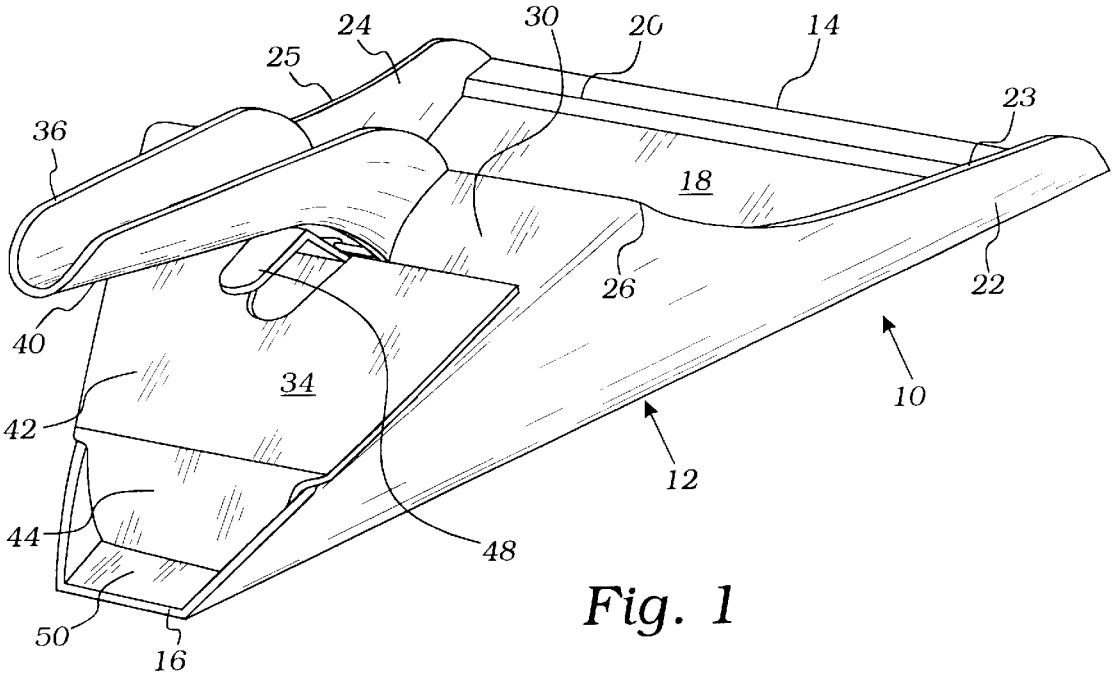
FIG. 1 is a perspective view of a device of the present invention looking toward a rear edge and door.
Figure 2:
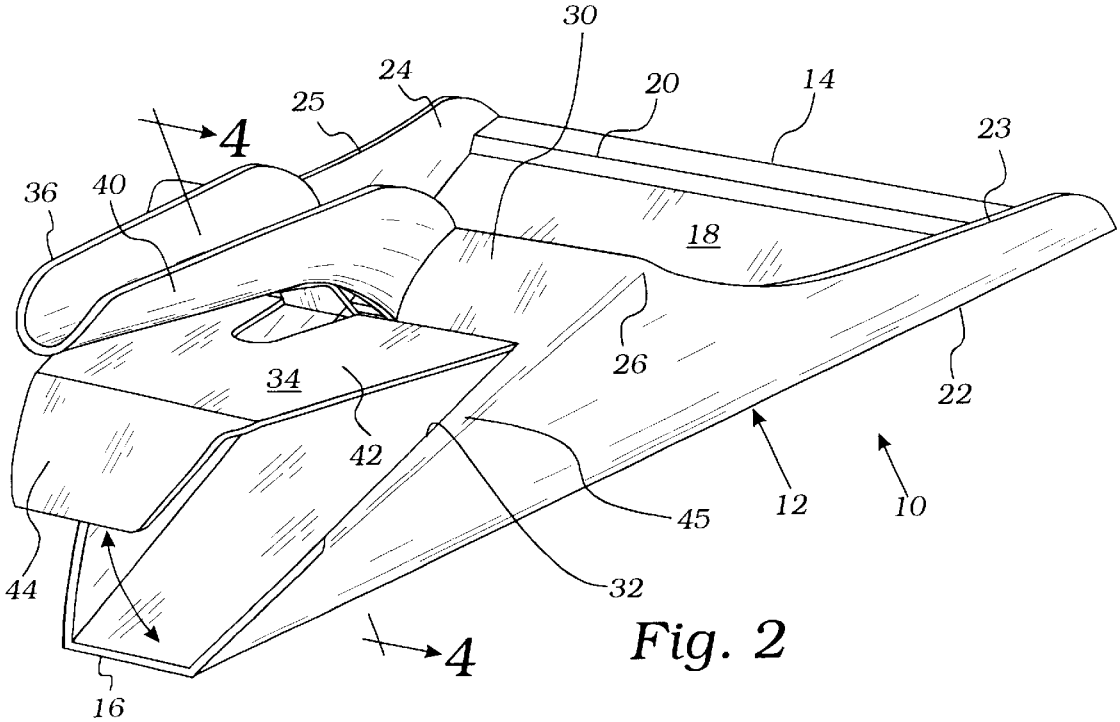
FIG. 2 is a further perspective view of the device, similar to FIG. 1, with the door in the open position.

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide for an improved and simplified cleaning device, hereinafter referred to as a dust funnel, generally indicated at 10. The device 10 preferably has a body 12 which is generally funnel shaped, with a first or wider front edge or end 14 and a second or narrower rear edge or end 16. The front edge 14 and rear edge 16 are connected together or formed at the opposite ends of a substantially flat, tapered bottom plate or surface 18, that may include a lip or raised portion 20, parallel to front edge 14. Side walls 22, 24 are formed integrally with or otherwise secured to the bottom plate or surface 18. The side walls 22, 24 are preferably angled outwardly more than 90° from the bottom surface 18 and taper inwardly toward the narrower rear edge 16 to guide or focus any debris from front edge 14 toward the rear edge 16. Furthermore, the side walls 22, 24 are sized and dimensioned to be generally triangular in shape, with front upper edges 23, 25 sloping upwardly to top portions of each wall, generally indicated at 26, 28. The top portions then slope downwardly and are secured to or integrally formed with a top or upper panel 30 having an opening 32 formed therein. Opening 32 is normally closed by a door 34 rotatably mounted to a handle 36.

Figure 4:
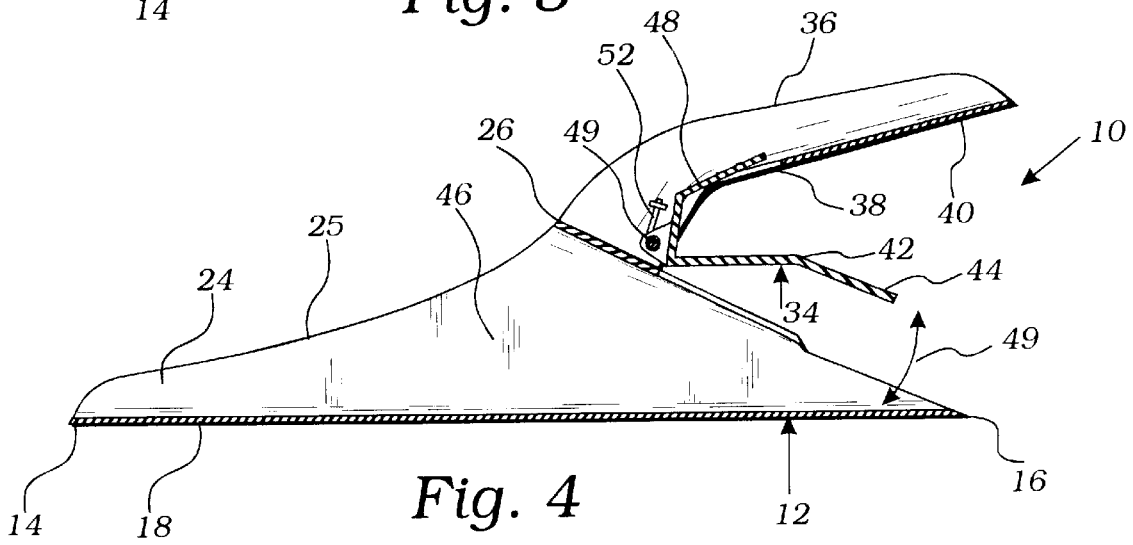
FIG. 4 is a cross-sectional view of FIG. 2.
Figure 5:
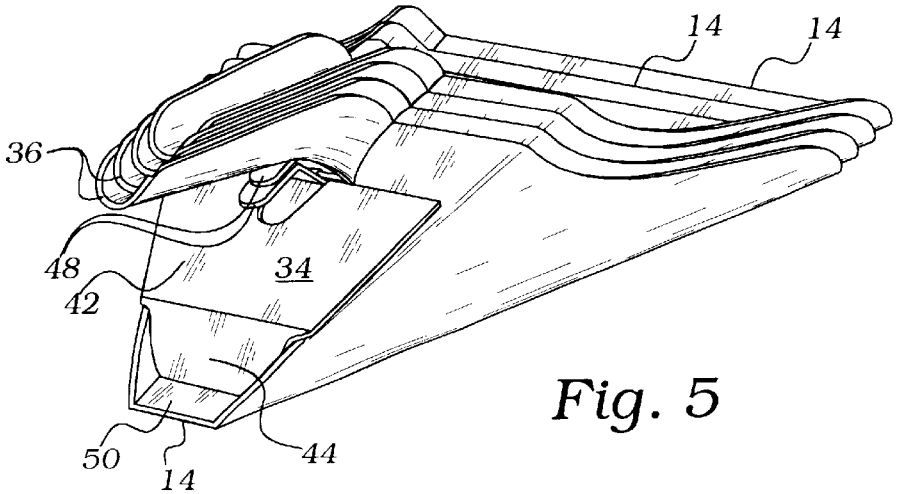
FIG. 5 is a perspective view of a plurality of devices of the present invention, shown stacked together for shipment or storage.
Figure 6:
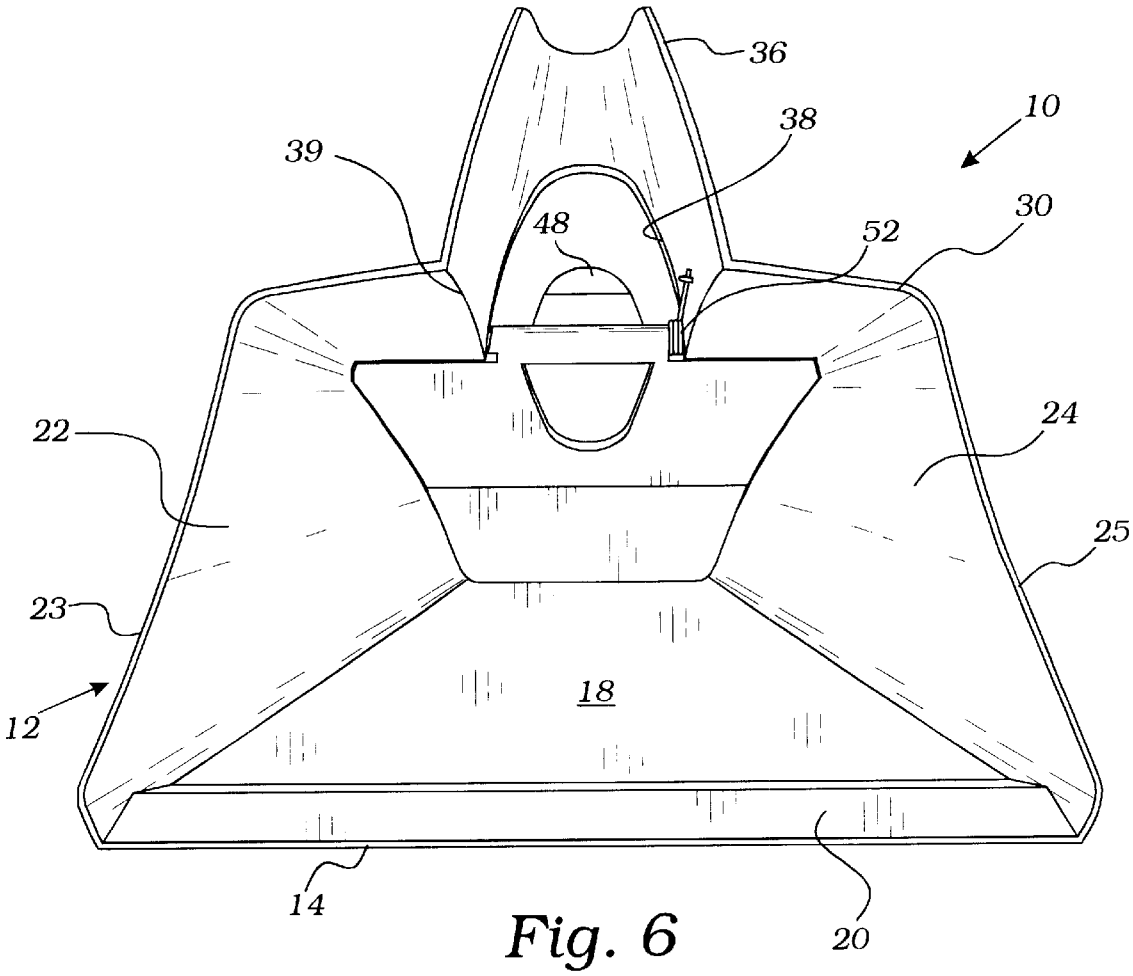
FIG. 6 is a front elevational view of the device of FIG. 1.

The handle 36 is fixedly secured to or integrally formed with upper panel 30, and includes an open portion 38 (see FIGS. 4 and 6). The handle 36 may take any desired shape, but is preferably formed so as to be U-shaped in cross-section, having a curved or rounded lower portion 40 that may be comfortably held in the hand of a user during debris pickup when flat on a floor or other surface, or when moved or rotated 90° with edge 14 pointing downwardly to empty debris therein. The U-shaped cross-section of handle 36 also provides a cutaway or open portion 39 in top 30 (see FIG. 6).

The upper panel 30 and side walls 22, 24 slope or taper downwardly and inwardly from portions 26, 28 until the side walls 22, 24 meet rear edge 16. The door 34 is formed with a flat upper portion 42 and a downwardly angled rear portion 44. The flat portion 42 of door 34 cooperates with upper edges 45 of the walls 22, 24 to prevent debris from escaping when swept into the internal funnel portion 46 formed in the body 12 of the device 10, from front edge 14. The angled rear portion 44 of the door fits tightly between inner surfaces of the rearwardly and inwardly tapering side walls 22, 24, and is self-centered therein when in the closed position with its lower edge sealed against plate 18.

The door 34 is operated by a trigger 48 integrally formed with or secured to the door 34. The trigger 48 is movable through opening 38 in handle 36 and is sized, shaped and dimensioned to work with opening 39 to allow a plurality of dust funnels 10 to be nested or stacked together, as shown in FIG. 6.

The device 10 may be made in any desired size, from any desired material, such as metal or plastic. For example, the body 12 of the device 10 may be molded or otherwise formed in one or more pieces. The overall shape of the device 10 is preferably that of a generally oblong or rectangular funnel to direct debris swept into front edge 14, out over back edge 16, when the device is raised and turned approximately 90° to a horizontal surface, over a trash container with the rear edge 16 pointed toward the trash container, so that the door 34 may be opened by trigger 48 and the debris allowed to fall into the trash container.

The trigger 48 is also preferably formed or mounted in the door adjacent an axle pin 49 (see FIG. 4) held in the opening 39, between opposed interior surfaces of the handle 36 (see FIG. 6). This mounting allows greater range of door motion.

Figure 3:
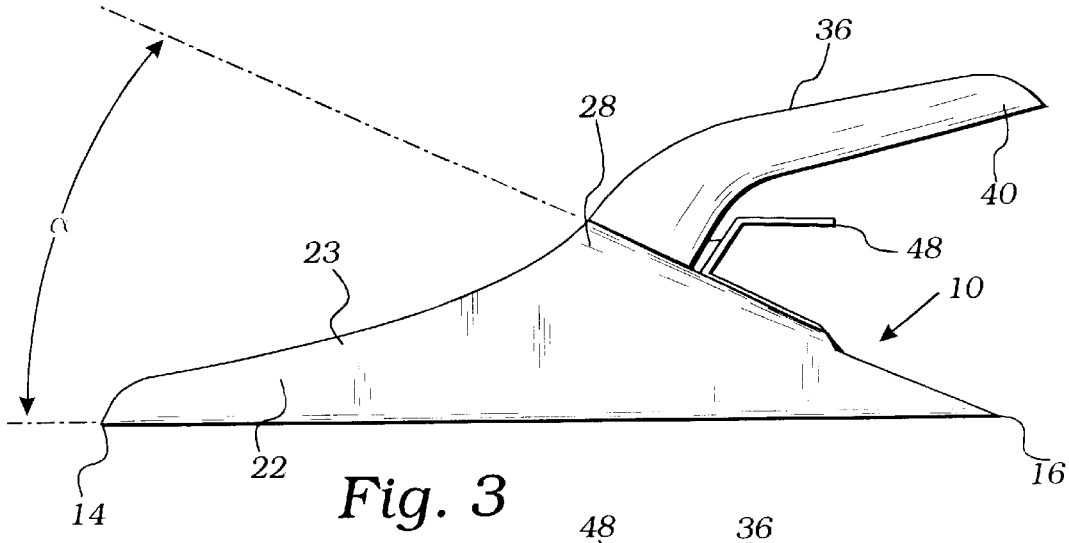
FIG. 3 is a side elevational view of FIG. 1.

In one preferred embodiment of the invention, the device 10 has a front edge 14, approximately 9¼"–10" wide, with side walls 22, 24 about 3¾"–4½" high, plate 18 about 12" long or deep, and rear edge 16 about 1⅝"–2" wide. The handle 36 is angled between 10° to 40° from the horizontal plate 18, preferably at 20° (70° from a line perpendicular to lower surface 18). The door 34 is preferably movable approximately 60° (see arrow 49 in FIG. 4), with the trigger 48 being capable of movement into opening 38 in handle 36. The rearwardly tapering side walls 22, 24 and upper surface or panel 30 are angled between 25° to 45° with respect to horizontal surface 18, preferably at approximately 30° (see angle $\alpha$ in FIG. 3). Additionally, a space 50 (see FIG. 1), extending between the area where the lower edge of the angled portion 44 of door 34 contacts the lower surface 18 and rear edge 16, forms a "tail chute" that both allows easy positioning of the device over a waste receptacle and aids in funneling debris into the waste receptacle. Finally, the centered hinge pin between the opposed sides of the handle 36 allows a single spring 52 (see FIGS. 4 and 6) to be used to bias the door into the closed position, against the top edges 45, inside surface of the side walls and the bottom surface 18, without distorting the door and/or trigger.

There has thus been described a novel and unique dust funnel that is adapted to easily pick up debris from any flat surface in a comfortable and natural manner and to then easily and quickly dump the debris in any available trash container by rotating the device 90° and operating a trigger to open a rear door.

Those skilled in the art will appreciate that various adaptations and modifications of the just-described preferred embodiments may be configured without departing from the scope and spirit of the invention. Therefore, it is to be understood that, within the scope of the appended claims, the invention may be practiced other than as specifically described herein.

What is claimed is:

1. A dust funnel, comprising:

a bottom panel having a front edge, a pair of side edges and a substantially narrower back edge;

a pair of outwardly angled side walls secured to the pair of side edges so as to converge toward the narrower back edge;

an angled and tapered top panel secured to top surfaces of the pair of outwardly angled side walls;

a handle secured to the angled and tapered top panel;

a door rotatably secured in the handle between the front edge and the back edge so as to close an opening formed between the angled and tapered top panel and the pair of outwardly angled side walls; and a trigger secured to the door adjacent a further opening formed in the handle; the trigger being movable to open the door.

2. The dust funnel of claim 1 wherein the handle is secured at an angle of between 10° to 40° from the bottom panel.

3. The dust funnel of claim 2 wherein the door is rotatable approximately 60°.

4. The dust funnel of claim 3 wherein the trigger is sized and dimensioned to pass through the further opening formed in the handle.

5. The dust funnel of claim 4 wherein the outwardly angled side walls and the angled and tapered top panel are angled with respect to the bottom panel between 25° to 45°.

6. The dust funnel of claim 1 wherein the door has two angled portions and is movable through an angle of approximately 60°.

7. The dust funnel of claim 6 wherein the outwardly angled side walls taper toward the back edge and the side walls and the angled and tapered top panel are angled with respect to the bottom panel between 25° to 45°.

8. The dust funnel of claim 7 wherein the handle is U-shaped in cross section and is secured at an angle of between 10° to 40° with respect to the bottom panel.

9. The dust funnel of claim 8 wherein a plurality of dust funnels may be stacked together with their U-shaped handles nested together.

10. A cleaning device comprising:

a body having a generally funnel shape;

the body having a substantially flat bottom panel with a substantially narrower rear edge, a substantially wider front edge and a pair of angled side edges;

a pair of angled side walls secured along the pair of angled side edges;

the angled side walls being substantially triangular in shape with top portions;

a top panel secured to top surfaces of the pair of angled side walls so as to extend from the top portions toward the narrower rear edge;

an opening formed in the top panel between the pair of angled side walls;

a handle secured to the top panel at an angle with respect to the substantially flat bottom panel;

a door rotatably secured in the handle, between the top portions and the substantially narrower rear edge to open and close an opening formed in the top panel and the pair of angled side walls;

a trigger secured to the door adjacent a further opening formed in the handle; and a spring mounted on a pin holding the door in the handle to bias the door to a closed position sealing the opening.

11. The cleaning device of claim 10 wherein the handle is secured at an angle of between 10° to 40° from the bottom panel.

12. The cleaning device of claim 11 wherein the door is rotatable approximately 60°.

13. The cleaning device of claim 12 wherein the trigger is sized and dimensioned to pass through the further opening formed in the handle.

14. The cleaning device of claim 13 wherein the angled side walls and the top panel are angled with respect to the bottom panel between 25° to 45°.

15. The cleaning device of claim 10 wherein the door has two angled portions and is movable through an angle of approximately 60°.

16. The cleaning device of claim 15 wherein the angled side walls taper toward the rear edge and the side walls and the top panel are angled with respect to the bottom panel between 25° to 45°.

17. The cleaning device of claim 16 wherein the handle is U-shaped in cross section and is secured at an angle of between 10° to 40° with respect to the bottom panel.

18. The cleaning device of claim 17 wherein a plurality of cleaning devices may be stacked together with their U-shaped handles nested together.

19. A cleaning device comprising:

a body having a generally funnel shape;

the body having a substantially flat bottom panel with a substantially narrower rear edge, a substantially wider front edge and a pair of angled side edges;

a pair of angled side walls secured along the pair of angled side edges;

the angled side walls being substantially triangular in shape with top portions;

a top panel secured to top surfaces of the pair of angled side walls so as to extend from the top portions toward the narrower rear edge at an angle of approximately 30°;

an opening formed in the top panel between the pair of angled side walls;

a U-shaped handle secured to the top panel at an angle of approximately 20° with respect to the substantially flat bottom panel;

a door having two angled portions rotatably mounted in the handle in an opening formed in the top panel, between the top portions and the substantially narrower rear edge; the door being movable through an angle of approximately 60°;

a trigger secured to the door adjacent a further opening formed in the handle; and a spring mounted on a pin rotatably holding the door in the handle to bias the door to a closed position sealing the opening.

20. The cleaning device of claim 19 wherein a plurality of cleaning devices may be stacked together with their U-shaped handles nested together.

* * * * *